US012146279B2

(12) United States Patent
Potter

(10) Patent No.: US 12,146,279 B2
(45) Date of Patent: Nov. 19, 2024

(54) PORTABLE VEHICLE BARRIER

(71) Applicant: Thomas E. Potter, Hummelstown, PA (US)

(72) Inventor: Thomas E. Potter, Hummelstown, PA (US)

( * ) Notice: Subject to any disclaimer, the term of this patent is extended or adjusted under 35 U.S.C. 154(b) by 841 days.

(21) Appl. No.: 17/221,167

(22) Filed: Apr. 2, 2021

(65) Prior Publication Data

US 2021/0348348 A1 Nov. 11, 2021

Related U.S. Application Data

(60) Provisional application No. 63/021,952, filed on May 8, 2020.

(51) Int. Cl.
*E01F 13/12* (2006.01)

(52) U.S. Cl.
CPC ..... *E01F 13/12* (2013.01)

(58) Field of Classification Search
None
See application file for complete search history.

(56) References Cited

U.S. PATENT DOCUMENTS 4,828,424 A * 5/1989 Crisp, Sr. ..... E01F 13/123 404/6
5,829,912 A * 11/1998 Marcotullio ..... E01F 13/024 49/34
5,993,104 A * 11/1999 Marcotullio ..... E01F 13/024 49/34
6,115,964 A * 9/2000 Hix ..... E06B 11/027 49/269
6,227,523 B1 * 5/2001 Haberlen ..... E01F 13/048 246/127
7,025,526 B2 * 4/2006 Blair ..... E01F 13/105 404/9
7,581,351 B2 * 9/2009 Lewis ..... E01F 13/12 49/260
8,439,594 B1 * 5/2013 Clark ..... E01F 13/123 404/9
2021/0010216 A1 * 1/2021 McKenna ..... E01F 13/044

* cited by examiner

*Primary Examiner* — Thomas B Will
*Assistant Examiner* — Katherine J Chu
(74) *Attorney, Agent, or Firm* — Miller Law Group, PLLC

(57) ABSTRACT

A portable vehicle barrier is transportable to a desired location, unfolded from a compact transport configuration and deployed to provide an effective vehicle barrier that can be used temporarily and then refolded into the compact transport configuration and transported to a remote location for utilization or storage. The vehicle barrier is formed with a central base having front and rear sections that are pivotally hinged to the central base. A barrier member can be selectively activated to rise into an active position and restrain the passage of vehicles. An impact into the barrier member causes the central base to tip in order to drive pointed teeth into the tires of the vehicle and into the underlying road surface and stop the impacting vehicle. The front and rear sections have vertical bars that move into a nesting horizontal position when the front and rear sections are pivoted into the transport position.

20 Claims, 7 Drawing Sheets

PORTABLE VEHICLE BARRIER

CROSS-REFERENCE TO RELATED APPLICATIONS

This application claims domestic priority on U.S. Provisional Patent Application Ser. No. 63/021,952, filed on May 8, 2020, the content of which is incorporated herein by reference.

FIELD OF THE INVENTION

The present invention relates generally to devices for preventing vehicles from passing beyond a predetermined point in a roadway to provide security control and, more particularly, to a portable security barrier that can be utilized in situations where a temporary control of traffic is desired.

BACKGROUND OF THE INVENTION

For many years, a small number of companies have sold vehicle security barriers primarily designed to thwart deliberate vehicle-based attacks of buildings. One configuration of these security barriers is a vertically pivoted beam that raises and lowers to allow or restrict, respectively, entry past the security barrier. Typically, a vertically pivoted beam security barrier consists of a beam member that is held in place by an actuator apparatus that is operated to pivot the beam vertically between a raised position in which vehicles are permitted to pass, and a lowered position where the beam is engaged with bolsters at each end of the beam to support the security barrier against an attacking vehicle. The actuator apparatus does not usually provide significant support to resist passage against an attacking vehicle. The operated actuator apparatus merely places and holds the beam in the proper position in engagement with the bolsters and moves the beam vertically to open the roadway.

Barriers come in numerous designs, but they can generally be categorized in three conventional types: plate, beam, and bollard. The plate barrier can be oriented to lay relatively flat on the surface of the roadway and be selectively actuated to be angled upwardly upon a perceived threat to form a wedge that restricts passage of a vehicle. The plate barrier is considered to be a permanently installed device as the plate is supported on a concrete encased frame that is buried into the surface of the roadway. A variation of the plate barrier has been introduced recently into the marketplace as a portable barrier. Another variation is to fasten the plate barrier to the roadway, such as with bolts. This barrier device is essentially a plate type barrier that is not imbedded in concrete, but instead can be moved to different locations to accommodate the need for temporary or changing security needs. Since the portable plate barrier is not imbedded in concrete, stopping power is relatively limited.

The beam barrier incorporates a vertically movable beam that is typically pivotally supported at one end of the beam by a steel support that is imbedded in concrete to provide a relatively immovable object and at the opposing end by a similar steel support at the opposing side of the roadway. The beam barrier serves as a movable gate that can be raised vertically (or swung horizontally) to allow vehicles to pass or lowered into engagement with the steel supports at either end of the beam to provide a substantial resistance to the passage of any vehicle. As with the conventional plate barrier, the beam barrier provides a permanent installation and relatively high stopping power. Some beam barriers use bands of nylon or similar material that are contained within the hollow beam and wrapped around the pivot structure for the beam to increase the resistance of the aluminum or steel beam.

The bollards are typically permanently installed steel or concrete barriers that are typically not selectively movable, although vertical movement could be provided to permit the structure to rise into a passage restrictive position above the surface of the roadway, or be retracted into the ground to permit the passage of vehicles. Generally, bollards are a permanent structure that cannot be made portable without loss of substantial stopping power capabilities.

Historically, vehicle barriers achieved their effectiveness by their mass and by the fact that they were permanently anchored in concrete. The vehicle barrier produced by known manufacturers is a beam-type of barrier that utilizes bands in the drop arm (beam) that are utilized to help stop the passage of vehicles. This barrier uses heavy-duty commercial straps or bands (usually nylon) of the kind used to lift large static loads in other commercial applications. While the bands are very strong and have a high stopping power, this beam-type barrier utilizes massive structures to engage each end of the movable beam to resist the impact of the oncoming vehicle. The bands are used to reinforce the drop arm and are anchored at the ends of the drop arm.

Conventional barriers have another disadvantage inherent in their designs in that each barrier design requires active mechanical movement of very heavy structures. Heavy steel plates (plate barriers) or heavy cylinders (bollard barriers) have to be raised against gravity in order to stop vehicles. Current vehicle barriers require approximately two seconds for emergency activation from an open position in which the vehicle can pass by the barrier to a deployed position in which a vehicle is prevented from passing by or over the barrier. Activation times for conventional beam barriers and sliding gate barriers are even longer, averaging about ten seconds for barriers that are one traffic lane wide and substantially longer for larger two lane barriers.

All of these categories of vehicle security barriers are manufactured with substantial mass and are permanently installed at a desired site on a highway or ramp. Such vehicle security barriers are not intended to be moved or replaced except in the event of destruction from impeding the passage of a vehicle. Many situations exist in which a temporary control of vehicle passage is desired, but the situation doesn't warrant the cost and/or time required for the installation of a permanent vehicle security barrier. Such situations may include a music concert, a political meeting, a police emergency, etc.

It would be desirable to provide a configuration of a vehicle security barrier that could be temporarily deployed and then removed and placed elsewhere on a temporary basis. A portable barrier could be supplied by a rental company that rents the barrier for temporary use and then retrieves the barrier when the rental period has expired.

SUMMARY OF THE INVENTION

It is an object of this invention to overcome the disadvantages of the prior art by providing a portable vehicle barrier that can be positioned for deployment for one location to another.

It is another object of this invention to provide a configuration for a vehicle barrier that can be transported as desired from one location to another.

It is a feature of this invention that a barrier member is pivotally movable from a passive position in which vehicles can pass over top of the barrier to an active position in which vehicles are prevented from passing over the top of the barrier member.

It is an advantage of this invention that the pivotal movement of the barrier member between the passive and active positions can be actuated by a hydraulic cylinder.

It is another feature of this invention that the base of the vehicle barrier includes a central base section and front and rear sections that are hinged to the central base section.

It is still another feature of this invention that the central base section is formed with pointed teeth between the central section and both the front and rear sections.

It is another advantage of this invention that the impact of a vehicle into the barrier member raised into the active position causes the central base section to tip about the hinge between the rear section and the central base section to raise the front portion of the vehicle and force the front teeth into the tires or the understructure of the impacting vehicle.

It is still another advantage of this invention that the impact of a vehicle into the barrier member raised into the active position also causes the rear teeth to dig into the underlying road surface to restrict movement of the vehicle barrier over the surface of the road.

It is still another advantage of this invention that the teeth are aligned with corresponding notches in the front and rear sections when the portable vehicle barrier is in the passive position to allow vehicles to travel over the vehicle barrier without damage.

It is still another object of this invention that the vehicle barrier can be folded into a compact package for convenient transport of the vehicle barrier to a remote location for deployment at the remote location.

It is still another feature of this invention that the placement of the vehicle barrier into a compact transport package enables the portable vehicle barrier to be engaged by a fork lift apparatus to be loaded onto a vehicle or trailer for transportation to a remote location.

It is yet another feature of this invention that the front and rear sections are provided with a bar member that is oriented perpendicularly to the front and rear sections on opposing sides thereof to extend vertically when the vehicle barrier has been deployed.

It is yet another advantage of this invention that the vertical bars members are spaced laterally a sufficient distance to allow the passage of vehicle therebetween.

It is still another advantage of this invention that the vertical bars are formed from angle iron so that the bar members on the same side of the front and rear sections will nest when the front and rear sections are pivoted upwardly about the hinge connection to the central base member to convert the vehicle barrier into a compact transport configuration.

It is yet another object of this invention to provide a portable vehicle barrier that is inexpensive of manufacture, easy to assemble, carefree of maintenance and simple and effective in use.

These and other objects, features and advantages will be found by providing a portable vehicle barrier that can be transported to a desired location, unfolded from a compact transport configuration and deployed to provide an effective vehicle barrier that can be used for a temporary basis and then refolded into the compact transport configuration and transported to a remote location for utilization or storage. The vehicle barrier is formed with a central base having front and rear sections that are pivotally hinged to the central base. A barrier member can be selectively activated to rise into an active position and restrain the passage of vehicles. An impact into the barrier member causes the central base to tip relative to the front hinge and drive pointed teeth into the tires of the vehicle and into the underlying road surface and stop the forward movement of the impacting vehicle. The front and rear sections have vertical bars that move into a nesting horizontal position when the front and rear sections are pivoted into the transport position.

BRIEF DESCRIPTION OF THE DRAWINGS

The advantages of this invention will be apparent upon consideration of the following detailed disclosure of the invention, especially when taken in conjunction with the accompanying drawings wherein.

DETAILED DESCRIPTION OF THE PREFERRED EMBODIMENT

Figure 1:
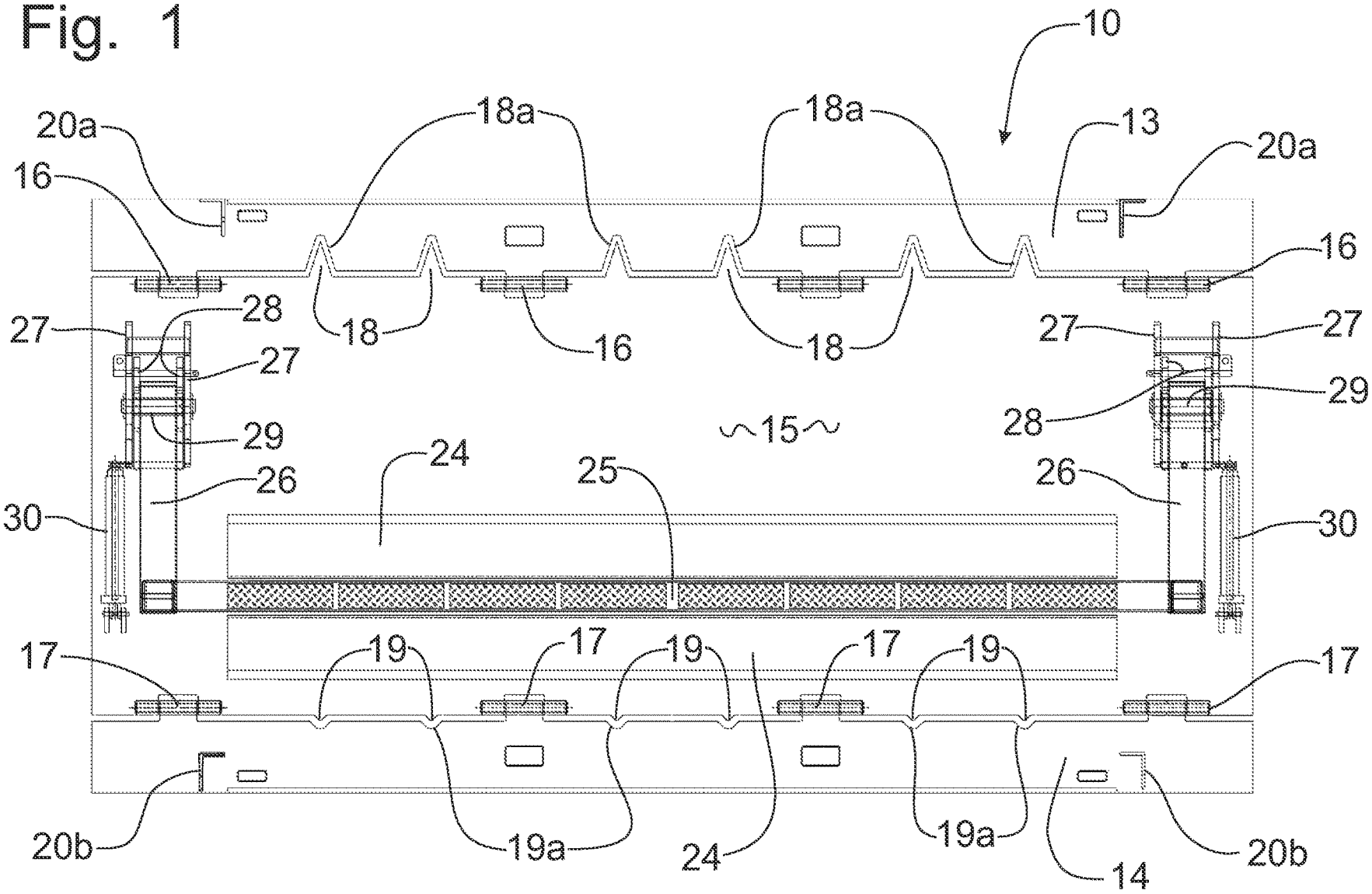
FIG. 1 is a top plan view of a portable vehicle security barrier incorporating the principles of the instant invention, the barrier is shown is a passive position in which vehicles are permitted to pass over the surface of the barrier.
Figure 2:
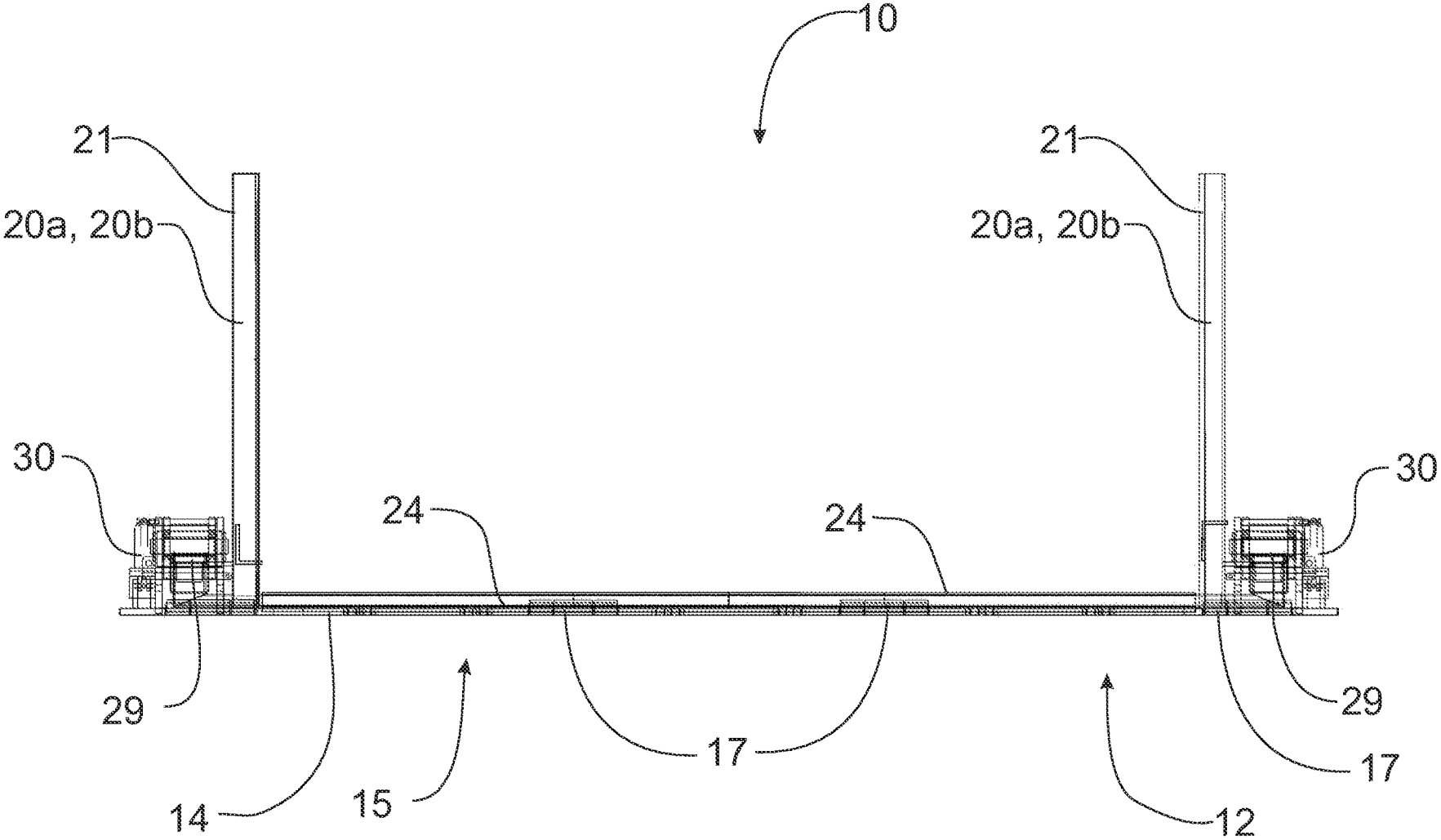
FIG. 2 is a front elevational view of the portable vehicle security barrier shown in FIG. 1.
Figure 3:
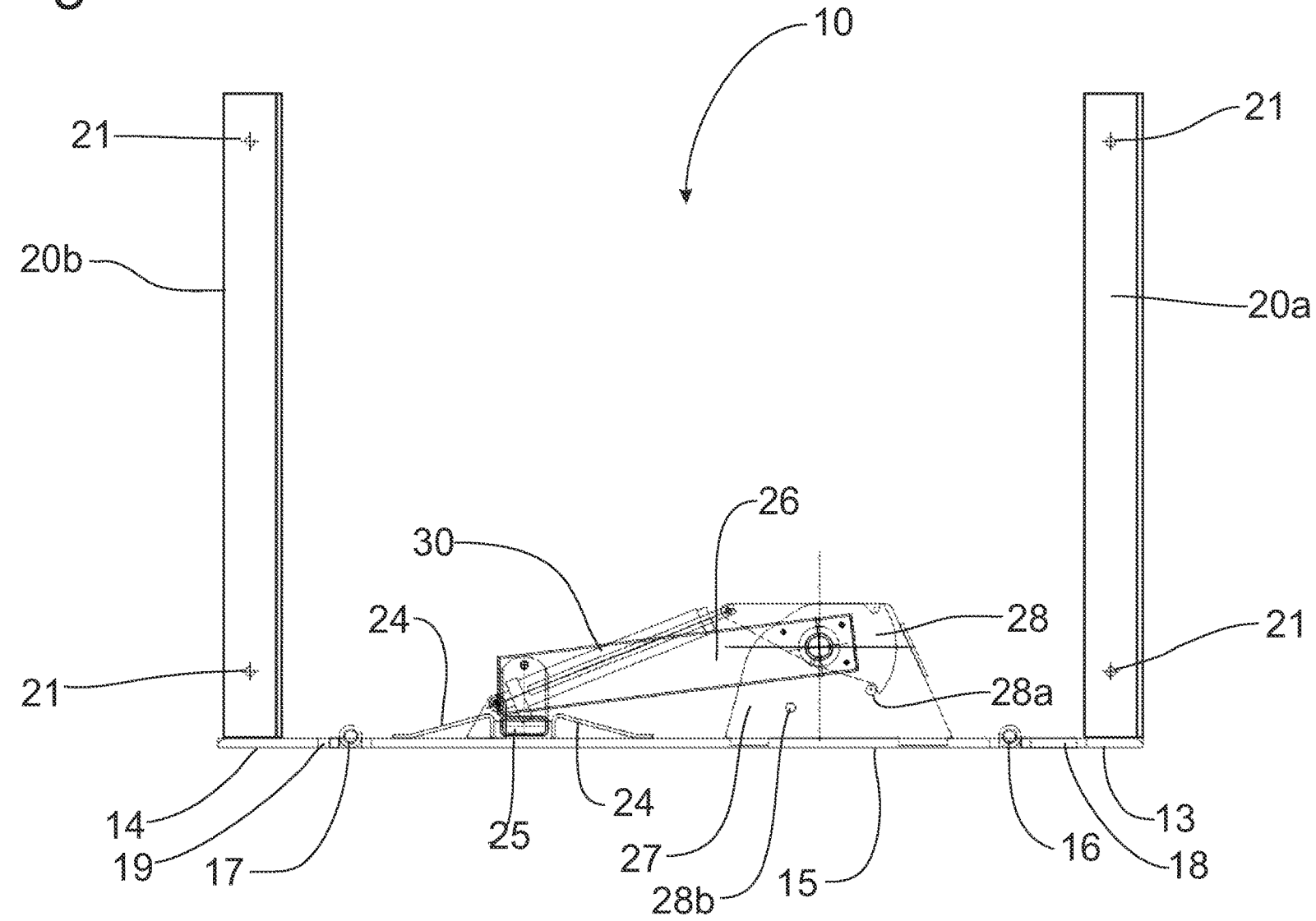
FIG. 3 is a side elevational view of the vehicle security barrier shown in FIG. 1 in the passive position.
Figure 4:
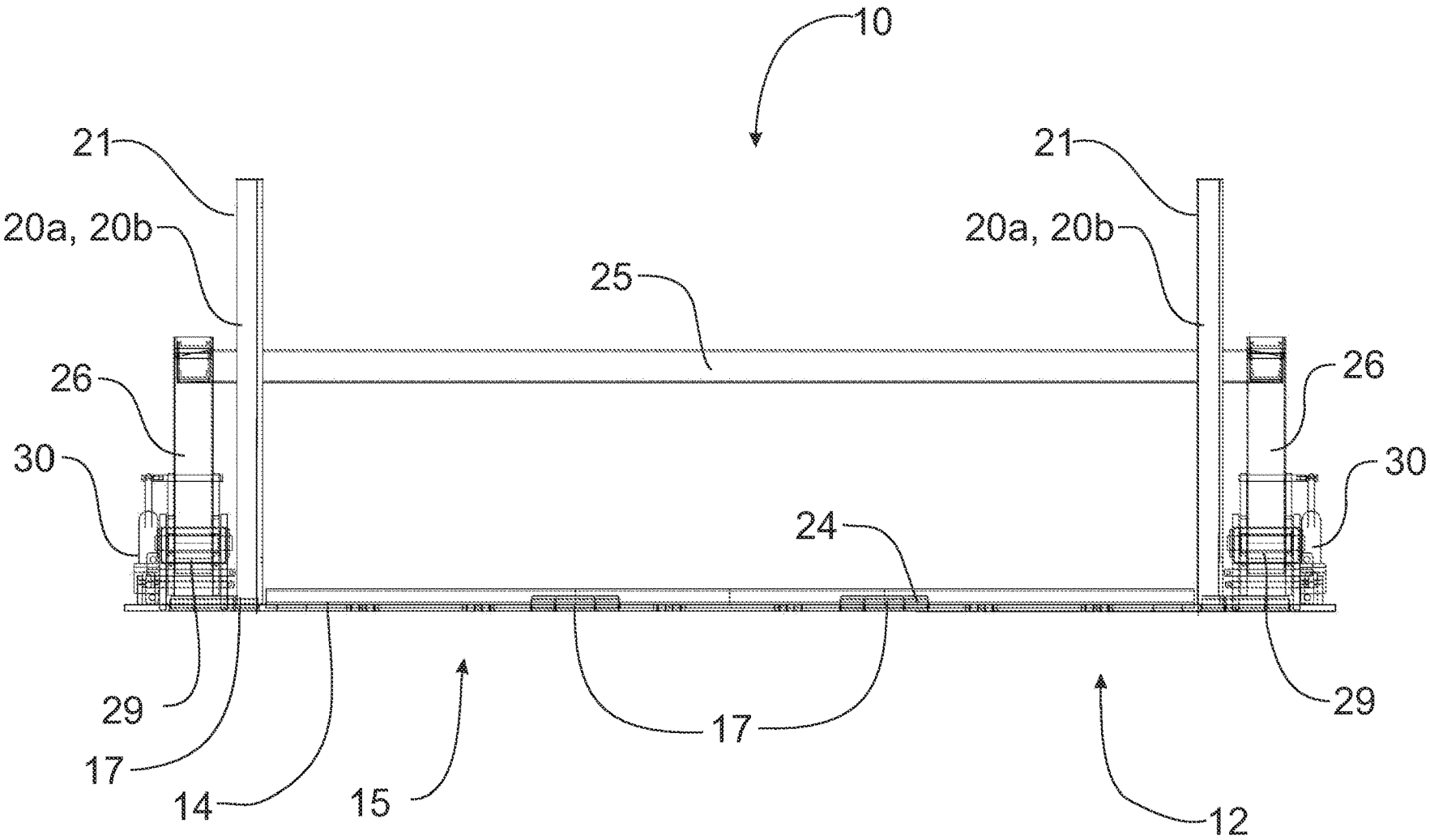
FIG. 4 is a front elevational view of the portable vehicle security barrier with the barrier deployed into an active position to stop the passage of vehicles over the barrier.
Figure 5:
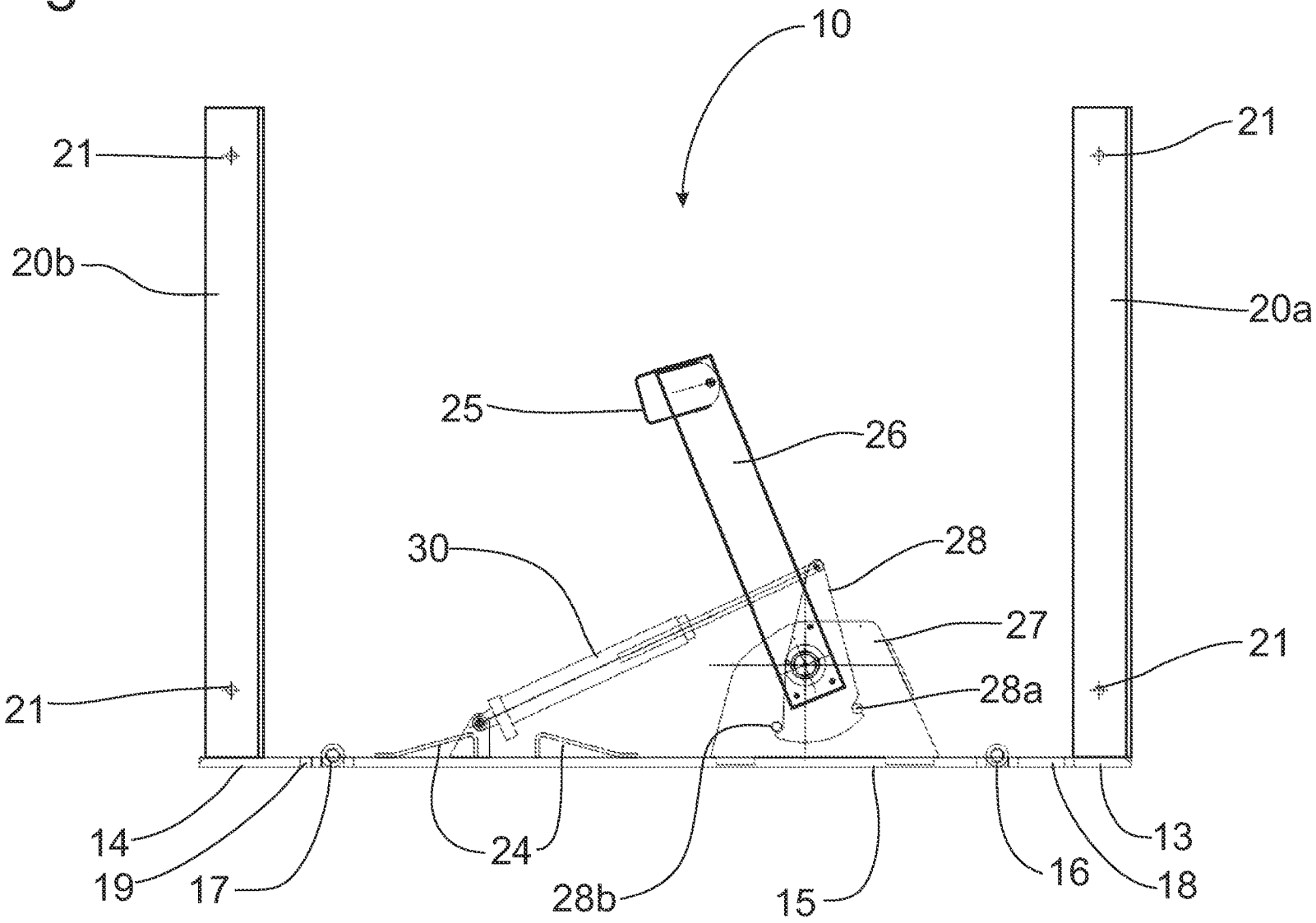
FIG. 5 is a side elevational view of the portable security barrier as shown in FIG. 4 in the active position.

Referring now to FIGS. 1-5, a portable vehicle security barrier incorporating the principles of the instant invention can best be seen. The vehicle security barrier 10 incorporates a beam 25 that is pivotally moved by an actuator 30 that can be manually, electrically or hydraulically driven to pivot the beam 25 between a lowered passive position, as shown in FIGS. 1-3 and a raised active position, as shown in FIGS. 4 and 5, to resist the passage of a vehicle over the surface of the portable vehicle barrier 10.

The base 12 of the vehicle security barrier 10 is formed in three pieces, including a front section 13, a rear section 14 and a central section 15. The front and rear sections 13, 14 are pivotally connected to the central section 15 and can pivot vertically relative to the central section through horizontally disposed pivot axes 16, 17. The pivotal movement of the front and rear sections 13, 14 are operational in the resistance of the passage of a vehicle over the surface of the barrier 10 and in the placement of the barrier 10 into a compact transport configuration, as both will be described in greater detail below. Preferably, the front edge of the central section 15 is formed with a plurality of forwardly pointed teeth in the form of triangular members 18 that align with corresponding notches 18*a* in the front section 13. Similarly, the rear edge of the central section 15 can be provided with rearwardly pointed teeth in the form of triangular members 19 that align with corresponding notches 19*a* formed in the rear section 14.

As is best seen in FIGS. 2 and 3, both the front and rear sections 13, 14 have bars 20*a*, 20*b* affixed to the lateral ends of the front and rear sections 13, 14. These bars 20 are preferably formed from angle iron that enables a nesting relationship between the front bars 20*a* and the rear bars 20*b* when the barrier is moved into the compact transport configuration, as will be described in greater detail below. One skilled in the art will understand that the transverse width of the base 12 is sufficient to cover the highway lane or ramp on which the barrier is to be deployed. Accordingly, the spacing between the front and rear bars 20*a*, 20*b* is sufficient for the passage of a vehicle therebetween, as the front and rear bars 20*a*, 20*b* are vertically oriented when the barrier is deployed, as depicted in FIG. 1.

The central section 15 is provided with the beam 25 and mounting structure for the beam 25. The beam 25 extends transversely across most of the entire width of the central section 15 and spans across the travel portion of the central section that can be defined as the transverse distance between the respective upright bars 20*a*, 20*b*. As is best seen in FIGS. 1 and 3, the front and rear upright bars 20*a*, 20*b* are positioned on the front and rear sections 13, 14 at a location that is interior of the mounting structure 30 for the beam 25. As a result, one function of the upright bars 20*a*, 20*b* is to restrict the passage of a vehicle that would otherwise be running over the mounting structure 30, and also to define a travel path for a vehicle passing over the surface of the base 12.

The beam 25 is oriented in a horizontal, transversely extending orientation and is connected to transversely spaced mounting legs 26 that are pivotally supported between transversely spaced, vertical mounting brackets 27 affixed to the central section 15, such as by welding. The legs 26 and the beam 25 are preferably hollow and filled with elastic bands covered by a lightweight shell, in the manner described in U.S. Pat. No. 7,320,557, granted to Thomas E. Potter on Jan. 22, 2008. Such a configuration of the beam would have advantages of less mass for the actuator to pivot between the vertical and horizontal orientations, as will be described in greater detail below, which would also provide for less expensive manufacturing, easier installation and faster implementation of the beam into an active position.

An actuation arm 28 is affixed, such as by welding or bolting, to both sides of each mounting leg 26 and pivotally movable about the pivot pin 29 secured between the mounting brackets 27 with the corresponding mounting leg 26. An actuator 30 is mounted on the central section 15 outboard each pair of mounting brackets 27 and connected to the corresponding actuator arms 28. As is best seen in FIG. 3, the extension of the actuators 30 pivots the corresponding actuator arms 28 and the attached mounting leg 26 about the pivot 29, resulting in the raising of the beam 25 from a passive position between two ramp members 24 affixed to the central section 15 that allow vehicle tires to roll over the beam 25 when placed in the passive position without causing damage to the beam 25.

The actuator arms 28 are formed with cutout shapes that engage with a detachable locking pin 28*a* and a fixed locking pin 28*b* received by the adjacent mounting bracket 27 to prevent movement of the actuator arms 28 when the beam 25 has been raised to the active position, as shown in FIGS. 4 and 5. After the locking pin 28*a* is inserted and the actuator arms are trapped between the fixed locking pin 28*b* and the detachable locking pin 28*a*, the central section 15, the actuator arms 28, mounting brackets 27, mounting legs 26 and beam 25 are all secured together. The operation of the actuators 30 is preferably accomplished manually so that the weight and cost of the barrier 10 can be minimized; however, remotely controlled hydraulic cylinders, or other remotely controlled devices, can be provided to enable the raising of the beam 25 from the lowered passive position to the raised active position. Manual actuators can include a manual pump-type of hydraulic cylinder or a manually operated screw-type actuator. Since the actuators 30 add little to the resistance of barrier 10 to the passage of a vehicle, even simple, lightweight actuators 30 can be utilized provided that the actuators 30 are capable of raising the beam 25.

Figure 6:
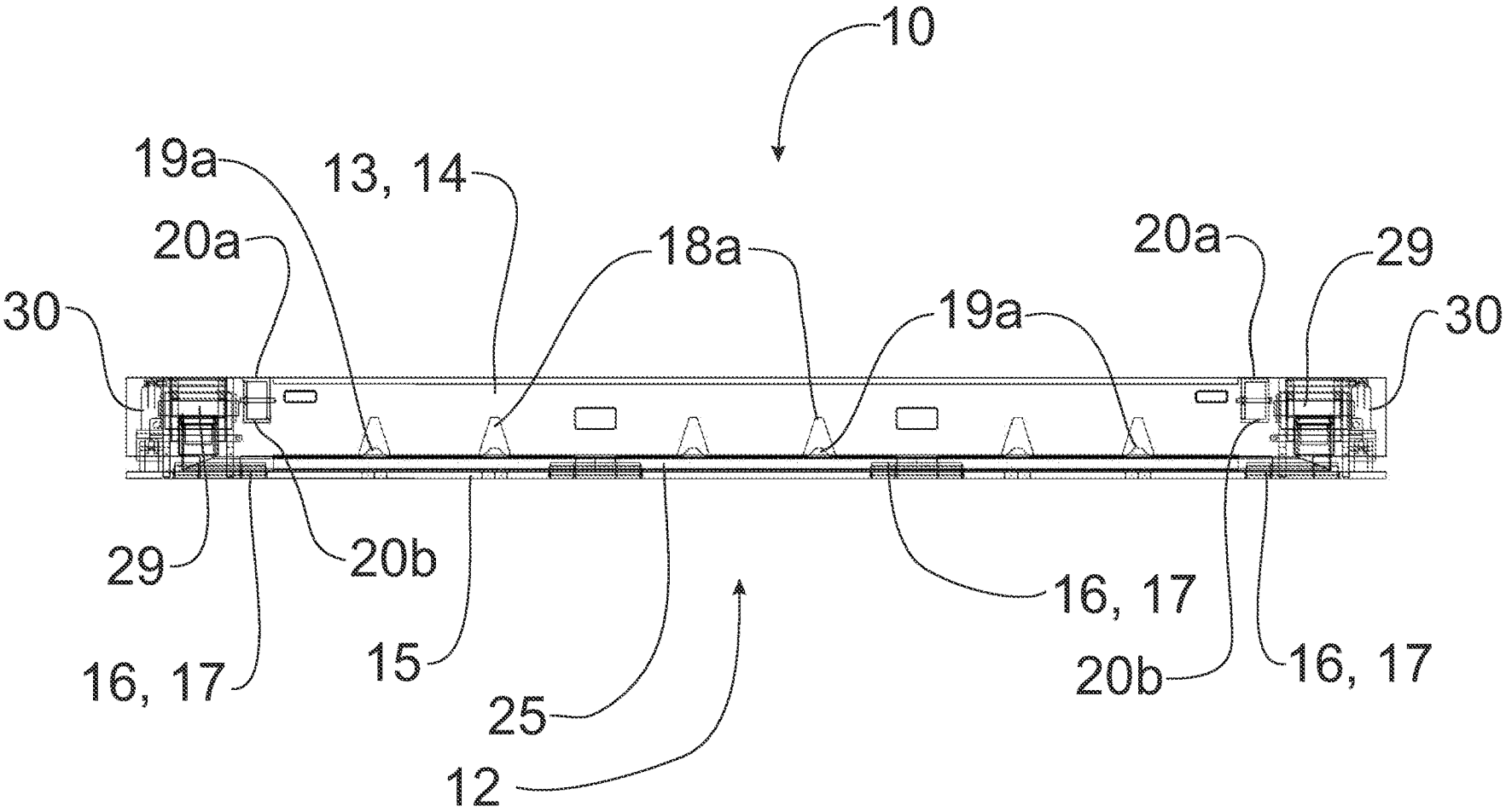
FIG. 6 is a front elevational view of the portable vehicle security barrier collapsed into a transport configuration for movement from one deployment position to another.
Figure 7:
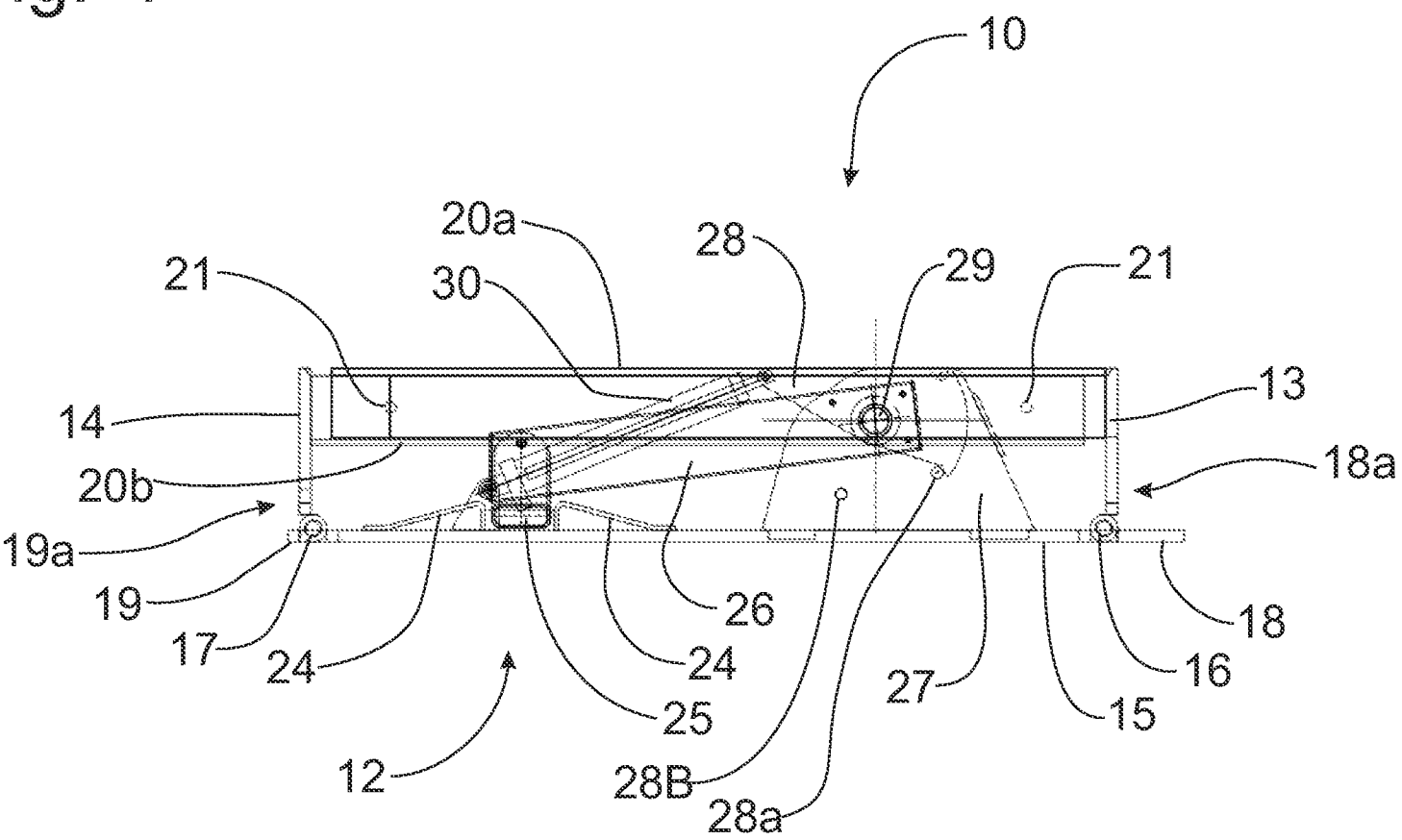
FIG. 7 is a side elevational view of the vehicle security barrier depicted in FIG. 6 collapsed into the transport configuration.

Referring now to FIGS. 6 and 7, the compact transport configuration of the barrier 10 can best be seen. In the transport configuration with the beam placed into the lowered passive position, the front section 13 and the back section 14 are pivoted upwardly relative to the central section 15. With the vertical bars 20*a*, 20*b* being arranged as shown in FIG. 1, the rear section 14 is pivoted upwardly first so that the upright bars 20*b* are positioned horizontally on the interior side of the mounting brackets 27 with the angle iron being oriented with the horizontal flange at the bottom and the vertical flange to the outside. The front section 13 is then pivoted upwardly relative to the central section 15 so that the upright bars 20*a* move into horizontal orientations that overlie the bars 20*b*. Preferably each of the bars 20*a*, 20*b* are formed with holes 21 that align with one another when in the transport configuration so that locking pins can be inserted into the aligned holes 21 to secure the respective front and rear bars 20*a*, 20*b* together. The central section 15 can be equipped with loops welded thereto so that the entire barrier can be lifted from the road onto a carrier that will move the barrier to the next job location. Alternatively, the barrier can be lifted by engaging the arms 20*a*, 20*b* that are secured together.

In operation, the barrier 10 is transported from a storage location to the deployment site in the compact transport configuration as depicted in FIGS. 6 and 7. The barrier 10 is then placed onto the deployment site. The locking pins in the aligned holes 21 are removed from the conjoined bars 20*a*, 20*b* so that the front and rear sections 13, 14 can be pivoted about the respective pivot axes 26, 27 by grasping first the front upright bars 20*a* and moving the upright bars 20*a* into their operational upright positions, and then by grasping the rear upright bars 20*b* and moving the rear upright bars 20*b* into the operative upright position. The barrier 10 is then fully deployed. One skilled in the art will recognize that the barrier is not secured to the highway and is not mounted into the surface of the highway. Accordingly, the simple deployment of the barrier 10 does not damage the highway.

So long as the beam 25 is disposed in the lowered passive position between the ramps 24, vehicles can cross over the surface of the barrier 10 between the upright bars 20*a*, 20*b* unimpeded. When the barrier 10 is needed to block the movement of vehicular traffic over the barrier 10, an operator will extend the two actuators 30 to pivot the actuator arms 28 and the attached mounting legs 26 and beam 25 into the raised active position shown in FIGS. 4 and 5, which places the actuator arms 28 into contact with the fixed locking pin 28*a*. The detachable locking pins 28*a* are then inserted into the respective holes in the mounting brackets 27 on the forward sides of the actuator arms 28 to lock the actuator arms 28 in the pivoted position corresponding to the raised active position of the beam 25. The barrier 10 is then ready to resist the passage of vehicles over the surface of the barrier 10.

The dimensions of the barrier 10, particularly the height of the beam 25 when placed into the raised active position, are such that the beam 25 will likely be impacted by a forward portion of the vehicle structure, such as the bumper, grill or hood before the front tires of the vehicle reach the front section 13 of the barrier 10. In those conditions, the impact of the vehicle into the raised beam 25 will cause the central section 15 of the barrier 10 to rotate about the rear pivot axis 27 to drive the rear small pointed triangular members 19 into the surface of the highway and provide resistance to rearward movement of the barrier. Simultaneously, the front edge of the central section 15 of the barrier 10 raises upwardly, pivoting about the front pivot axis 26, to drive the front pointed triangular members 18 into the undercarriage of the vehicle, or possibly into the front tires of the vehicle, depending on the dimensions of the vehicle, to engage the barrier 10 into the vehicle. This engagement between the barrier 10 and the undercarriage of the vehicle makes further movement of the vehicle difficult to accomplish.

However, with some vehicle configurations, the front wheels can be on top of the front section 13 when the beam 25 is impacted. In these situations, the bands (not shown) in the beam 25 will stretch and can stretch far enough that the front wheels of the vehicle reach the rear section 14, in which case the central section 15 will pivot as described above forcing the triangular front teeth 18 into the undercarriage of the vehicle. In the event the front wheels of the vehicle do not reach the rear section 14, the vehicle can end up pushing the barrier 10 along the roadway surface. Since the barrier 10 is expected to weigh approximately 6,000 pounds, the mass of the barrier 10 will restrict movement of the vehicle.

Assuming that the barrier 10 not been deformed by an impact with a vehicle, the barrier 10 can be removed from the deployment site by pivoting the rear section 14 about the rear pivot axis 27 and then pivoting the front section 13 about the front pivot axis 26 to overlie the front bars 20*a* in a horizontal orientation above the rear bars 20*b*. Using the locking pins 28*a* to secure the respective pairs of overlying bars 20*a*, 20*b* together, places the barrier 10 into the compact transport configuration. The barrier 10 can then be lifted from the deployment site and placed onto a truck or trailer for return to the storage location to await a subsequent deployment opportunity. In this compact transport configuration, the barriers 10 can be stacked on top of one another to minimize storage space needed when the barriers 10 are not deployed.

One skilled in the art will recognize that this portable vehicle security barrier 10 is a lightweight barrier and has limitations with respect to the size of vehicles that the barrier 10 can stop. The heavier barriers that are buried into the ground or at least attached to the surface of the ground are operable to stop large trucks weighted down with cargo. This lightweight portable barrier 10 as described above is still operable to stop a vehicle and cargo as is described above. Although this capacity to stop vehicles is certainly less than the heavyweight, permanent barriers, this capacity is sufficient to provide service in lesser level security situations. Furthermore, a portable vehicle security barrier 10 fits a rental business model in which a product rental company would provide a vehicle security barrier for temporary utilization as needed locally. Other entities, such as governmental entities or quasi-governmental entities can own these barriers 10 for deployment as and where needed.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

What is claimed is:

1. A portable vehicle barrier for deployment on a roadway surface, comprising:

a base member having a central section, a front section pivotally connected about a forward transverse pivot axis to said central section and a rear section pivotally connected to said central section by a rearward transverse pivot axis, said central section having a transverse row of forward pointed teeth along said forward transverse pivot axis and a transverse row of rearward pointed teeth along said rearward transverse pivot axis;

a resistance structure including a transverse beam and orthogonal mounting legs at the opposing transverse ends of the transverse beam, said mounting legs being supported on a transverse pivot for vertical movement of said beam between a lowered passive position and a raised active position; and an actuator mechanism operatively coupled to said beam to move said mounting legs about said transverse pivot to affect movement of said beam between said passive position and said active position, an impact between a vehicle and said transverse beam when in said active position causing an upward pivotal movement of said central section about said rearward transverse pivot axis to drive said forward pointed teeth into said vehicle.

2. The portable vehicle barrier of claim 1 wherein the impact between said vehicle and said beam when in said active position further causes a downward pivotal movement of said rearward pointed teeth to drive said rearward pointed teeth into said roadway surface.

3. The portable vehicle barrier of claim 2 wherein said actuator mechanism includes a pair of actuator arms affixed to opposing sides of each mounting leg so as to be pivotally movable with said mounting leg, said resistance structure including a pair of mounting brackets having said transverse pivot secured therebetween.

4. The portable vehicle barrier of claim 3 wherein said actuator arms can be secured against corresponding mounting brackets by locking pins when said beam has reached said active position, thus locking the resistance structure to the actuator mechanism to restrain movement of said vehicle across said central section of said barrier.

5. The portable vehicle barrier of claim 4 wherein said front section and said rear section are formed with a plurality of notches extending, respectively, along said forward transverse pivot axis and said rearward transverse pivot axis and being positioned to align with and receive therein said forward pointed teeth and said rearward pointed teeth, respectively.

6. The portable vehicle barrier of claim 4 wherein said actuator mechanism includes a linear actuator to affect movement of the corresponding said actuator arms, said linear actuator being manually operable to cause said transverse beam to move from said passive position to said active position.

7. The portable vehicle barrier of claim 4 wherein said central section includes a pair of ramp members spaced longitudinally to provide a protected location for said transverse beam when placed into said passive position.

8. The portable vehicle barrier of claim 4 wherein each of said front section and said rear section have a pair of transversely spaced upright bars to define a travel path over said central section.

9. A method of restricting movement of vehicles over a roadway surface, comprising:

deploying a portable vehicle security barrier having a base member formed with a central section, a front section pivotally connected by a forward transverse pivot axis to said central section and a rear section pivotally connected to said central section by a rearward transverse pivot axis, said central section having a transverse row of forwardly pointed teeth along said forward transverse pivot axis and a transverse row of rearwardly pointed teeth along said rearward transverse pivot axis; and raising a transverse beam forming part of a resistance structure from a lowered passive position to a raised active position such that the impact of a vehicle into said transverse beam causes an upward pivotal movement of said central section about said forward transverse pivot axis to drive said forwardly pointed teeth into said vehicle.

10. The method of claim 9 wherein said step of deploying a portable vehicle security barrier includes the step of resting said barrier on said roadway surface without securing said barrier to said roadway surface.

11. The method of claim 9 wherein said step of raising a transverse beam includes the step of causing a downward pivotal movement of said central section about said rearward transverse pivot axis to drive said rearwardly pointed teeth into said roadway surface.

12. The method of claim 9 wherein said portable vehicle security barrier can be configured in a compact transport configuration in which a plurality of said portable vehicle security barriers can be stacked vertically.

13. The method of claim 12 wherein said compact transport configuration includes said front section is pivoted upwardly about said front transverse pivot axis relative to said central section and said rear section is pivoted upwardly about said rear transverse pivot axis relative to said central section.

14. The method of claim 13 wherein each of said front and rear sections have a pair of transversely spaced upright bars defining a travel path over said barrier when said barrier is in an operative configuration, said upright bars becoming horizontally oriented in positions where corresponding front and rear upright bars overlie one another when said barrier is in said transport configuration, a plurality of said barriers being capable of being stacked vertically when in said transport configuration.

15. A portable vehicle barrier for deployment on a roadway surface, comprising:

a base member having a central base section, a front section pivotally connected about a forward transverse pivot axis to said central section and a rear section pivotally connected to said central section by a rearward transverse pivot axis, said central base section having a transverse row of forwardly pointed teeth along said forward transverse pivot axis and a transverse row of rearwardly pointed teeth along said rearward transverse pivot axis;

a barrier apparatus including a transverse beam and orthogonal mounting legs at the opposing transverse ends of the transverse beam, said mounting legs being supported on a transverse pivot for vertical movement of said beam between a lowered passive position and a raised active position; and an actuator device operatively coupled to said transverse beam to selectively move said mounting legs about said transverse pivot and affect movement of said transverse beam between said passive position and said active position, an impact between a vehicle and said beam when in said active position causing an upward pivotal movement about said rearward transverse pivot axis to raise the forward transverse pivot axis and drive said forwardly pointed teeth into said vehicle.

16. The portable vehicle barrier of claim 15 wherein each of said front section and said rear section have a pair of transversely spaced upright bars to define a travel path over said central section, said bars being movable into a nested horizontal orientation.

17. The portable vehicle barrier of claim 16 wherein said front section and said rear section can be pivoted upwardly relative to said central section to orient said bars into a nested horizontal orientation with the corresponding bar, thereby placing said portable vehicle barrier into a compact transport configuration.

18. The portable vehicle barrier of claim 15 wherein the impact between said vehicle and said transverse beam when in said active position further causes a downward pivotal movement of said rearwardly pointed teeth into said roadway surface.

19. The portable vehicle barrier of claim 15 wherein said actuator mechanism includes a pair of actuator arms affixed to opposing sides of each mounting leg so as to be pivotally movable with said mounting leg, said resistance structure including a pair of mounting brackets having said transverse pivot secured therebetween, said actuator arms can be secured against corresponding mounting brackets by locking pins when said beam has reached said active position, thus locking the resistance structure to the actuator mechanism to restrain movement of said vehicle across said central section of said barrier.

20. The portable vehicle barrier of claim 19 wherein said actuator mechanism includes a linear actuator operable to affect movement of the corresponding said actuator arms, said linear actuator being manually operable to cause said transverse beam to move from said passive position to said active position.

* * * * *